US005251417A

United States Patent [19]

Yates, Jr.

[11] Patent Number: 5,251,417

[45] Date of Patent: Oct. 12, 1993

[54] DECORATIVE ART GLASS WINDOW GRID SYSTEM

[76] Inventor: H. Dale Yates, Jr., 6999 Oakland Rd., Loveland, Ohio 45140

[21] Appl. No.: 941,709

[22] Filed: Sep. 8, 1992

[51] Int. Cl.[5] ..... E06B 3/64

[52] U.S. Cl. ..... 52/456; 52/311.1; 52/656.2; 52/656.8; 52/668; 52/790

[58] Field of Search ..... 52/456, 789, 790, 311, 52/668, 788, 235, 656; 40/572

[56] References Cited

U.S. PATENT DOCUMENTS

| | | | |
|---|---|---|---|
| 3,024,880 | 3/1962 | Burmeister | 52/311 |
| 3,460,303 | 8/1969 | Algrain et al. | 52/789 |
| 3,512,320 | 5/1970 | Ferron et al. | 52/456 |
| 4,316,352 | 2/1982 | Harrington et al. | 52/456 |

FOREIGN PATENT DOCUMENTS

| | | | |
|---|---|---|---|
| 684931 | 12/1952 | United Kingdom | 52/263 |

*Primary Examiner*—Michael Safavi
*Attorney, Agent, or Firm*—Charles R. Wilson

[57] ABSTRACT

A decorative art glass grid system is intended for use in a double window pane unit. The unit itself fits into a window frame. The grid system comprises at least two elongated members to form a grid, a set of holding feet slidably positioned in the terminuses of the elongated members and, optionally, a set of resting pads positioned in the elongated members. Each elongated member has a first groove extending along one side of the member to receive an edge of an art glass pane, a second groove extending along an opposite side of the member to receive an edge of another art glass pane, and an interior channel. Each holding foot has a substantially flat base which has a groove in one face to receive the edge of an art glass pane and a post extending substantially vertically from the flat base to fit into the interior channel of the elongated member to hold it in place. Each resting pad has a flexible head portion which rests in the grooves and receives an edge of an art glass pane. The grid system is readily adapted to any size window frame and art glass pane. It is readily assembled and securely holds decorative art glass panes in a secure manner.

19 Claims, 4 Drawing Sheets

DECORATIVE ART GLASS WINDOW GRID SYSTEM

FIELD OF INVENTION

This invention relates to a window grid system. More particularly, the invention relates to a window grid system for mounting decorative art glass in a stable manner.

BACKGROUND OF INVENTION

Windows in a building have long been recognized as a source of energy lost. Heat is transferred out through the windows of the building in the winter. Heat is also transferred in through the windows in the summer. Several different energy efficient window systems have been developed in recent years. One popular system widely used in commercial and residential homes has been double window pane units often referred to as thermopane glass. In this system, two panes of window glass are mounted such that a dead air space exists in the middle. Air is a poor conductor of heat, thus the system as a whole is very energy efficient. Certain systems of this type even use a gas having a lower coefficient of heat transfer than air to further minimize heat transfer.

Windows are placed in buildings as a source of light and for the occupant to view the outside. They are primarily functional in nature. However, some commercial and residential building owners demand more. They want their windows to be aesthetically pleasing as well as functional. Leaded glass is one example of a material used to produce a decorative window. Beveled glass is another example of glass used in a window to give an aesthetically pleasing appearance. Various grid systems for mounting in a window frame also exist. These systems have a grid which can hold four or more separate panes of glass. The grid itself is usually made of a decorative material such as brass. Specifically, a grid system for holding beveled glass panes in a double window pane unit is known and has met with some commercial success. The systems are pleasingly attractive. However, they are difficult to assemble by the workman. The individual pieces must be connected in some manner. Solder, adhesives or connector pins are common, though all pose on-site problems. Some of the assembled systems even tend to rattle. A grid system easy to assemble at a reasonable cost which is rattle-free in use simply does not presently exist.

In accord with a need, there has been developed a decorative art glass window grid system. The grid system is readily mounted inside a double window pane unit. It is easy to assemble and securely holds decorative art glass panes in a centered stable position. The system also offers versatility in the size of glass panes and number of glass panes.

SUMMARY OF INVENTION

A grid system for use in a window frame holds decorative art glass panes in a stable manner. The system comprises at least two elongated members, a set of holding feet slidably positioned in the terminuses of the elongated members and, optionally a set of resting pads positioned in the elongated members. Each elongated member has a first groove extending along one side of the member to receive an edge of an art glass pane, a second groove extending along an opposite side of the member to receive an edge of another art glass pane, and an interior channel between the two grooves also extending along the length of the elongated member. Each holding foot has a substantially flat base which has a groove in one face to receive an edge of an art glass pane and a post extending substantially vertically from the flat base to fit into the interior channel of the elongated member to hold it in place. Each resting pad has a flexible head portion which rests in a groove and receives an edge of an art glass pane. The grid system is readily adapted to any size window frame and art glass pane. It is readily assembled and securely holds decorative art glass in a secure manner.

DETAILED DESCRIPTION OF INVENTION

The grid system of the invention is described in detail in the following paragraphs. The components of the grid system as well as the manner of assembling the components into the grid system to hold decorative art glass panes and mounting it within a double window pane unit are described.

Figure 1:
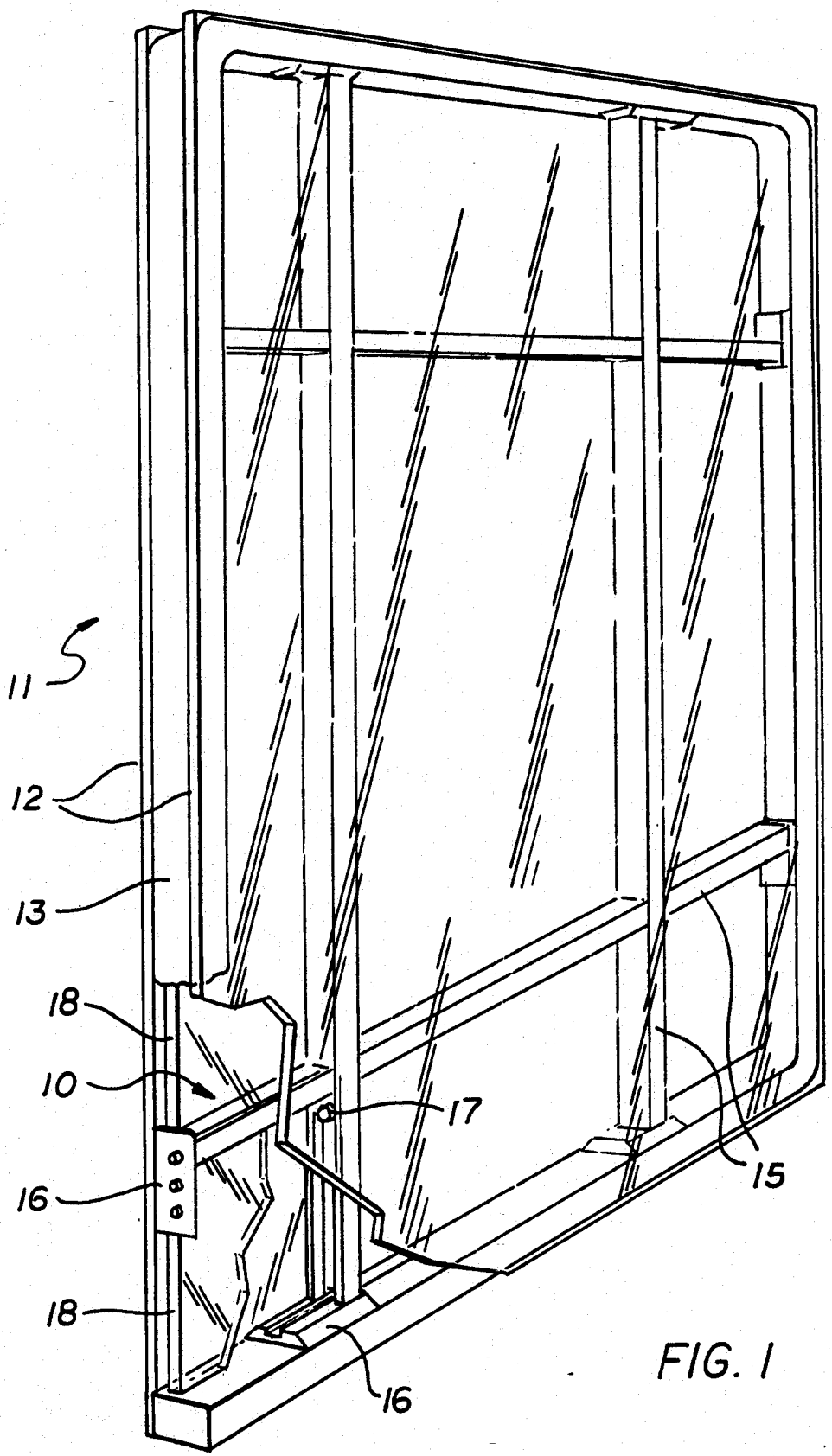
FIG. 1 is a perspective view of the grid system of the invention mounted in a double window pane unit.

With reference to FIG. 1, there is shown the grid system 10 of the invention mounted in a sealed double window pane unit 11. The sealed unit comprises two window panes 12 and a frame 13 along the four sides as its essential components. In the unit shown, the frame 13 is a soft polymeric strip liner which goes around the interior edges of the two window panes. The double window pane unit itself is ready for mounting in a window frame of a commercial or residential building.

The grid system 10 comprises as its essential components a set of at least two elongated members 15 and a set of holding feet 16. A set of resting pads 17 is preferably, though optionally used to better ensure against rattle. The components of the system are structured to hold a number of art glass panes 18 in a centered and stable position within the double window pane unit 11. The grid system shown is configured to hold nine panes of art glass. It should be understood that other configurations are possible to hold more or less art glass panes. It should also be understood that the individual glass panes can be same or different. That is, the panes can individually or collectively be beveled glass, etched glass or conventional glass. The elongated members are configured to accommodate the narrow beveled glass edges as well as the typical conventional glass edges. The panes can as well be different sizes. At least two elongated members are needed as a practical minimum. Two of the elongated members interconnected together holds four art glass panes. The upper limit of elongated members that can be interconnected together is dictated only by window frame size and aesthetic reasons.

Figure 2:
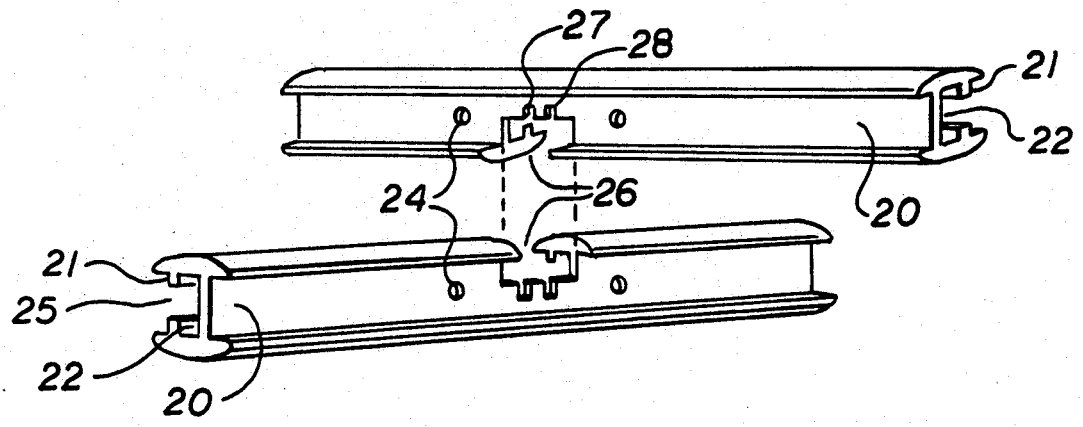
FIG. 2 is a perspective view of two elongated members of the grid system of FIG. 1 prior to assembly.
Figure 3:
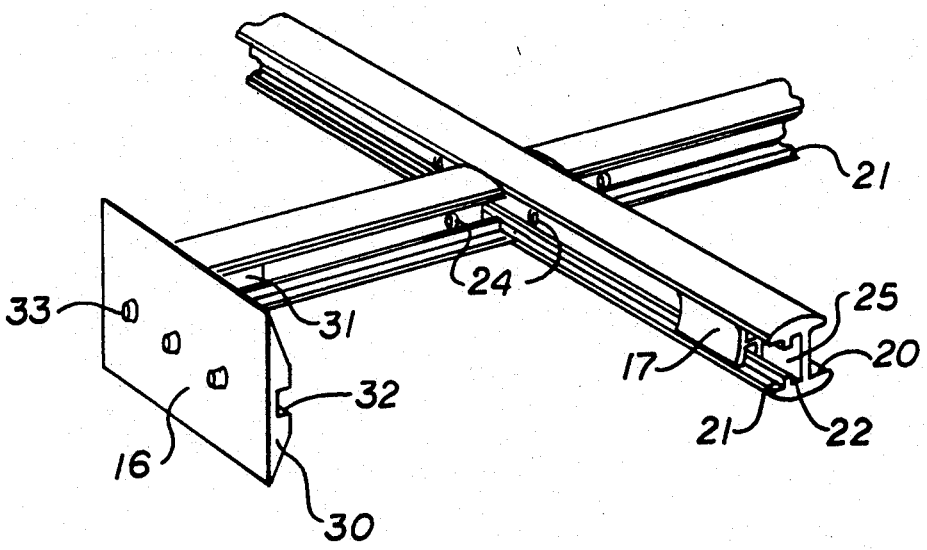
FIG. 3 is a perspective view in reverse of the two assembled elongated members of FIG. 2.

The elongated members 15 used in the grid system 10 to form a grid are identical in structure, though have different lengths to accommodate the particular vertical and horizontal dimensions of the double window pane unit. As best seen in FIGS. 2 and 3, each elongated member 15 has a first groove 20 extending entirely along one side of the member. The groove 20 is sufficiently wide to receive an edge of a conventional glass pane, typically about 100 to 125 mils in thickness. A second groove 21 extends along an opposite side of the elongated member its entire length. This groove also has a width sufficiently wide to receive an edge of a conventional glass pane. Preferably, for manufacturing reasons, and as shown, the bottom of the groove 21 is open and extends the entire length of the groove.

The elongated member 15 also has an interior channel 22 extending its entire length. The channel 22 is positioned between the first groove 20 and the second groove 21. A hole 24 in the bottom wall of the first groove 20 and a slot 25 in the bottom wall of the second groove 21 are for the purpose of accommodating the resting pads as more fully discussed below.

As is most apparent in FIG. 2, the first groove 20, the second groove 21 and the interior channel 22 all run the entire length of the elongated member 15 and are all parallel with one another. The second groove and the interior channel are in communication due to the slot 25 in their common wall.

As best seen in FIG. 2, each elongated member 15 has at least one notch 26. The notch is to accommodate a notch of another elongated member at the point where the members interconnect. The notch 26 is cut into the elongated member's side walls where needed. The notch extends approximately to the side wall's midpoints. Guide notches 27 and 28 are cut into the common wall between the first groove and the interior channel. The guide notches are preferably positioned equi-spaced within the confines of the notch 26 and are intended to lock into equivalent guide notches of another elongated member when the grid system is assembled. Burr-like protrusions can preferably be used at the mouths of the guide notches to provide a degree of locking. The two guide notches permit each elongated member to be universal, i.e. each can be a left or a right member.

The holding feet 16 are positioned in the terminuses of the elongated members 15. They serve the purpose of holding an edge of art glass pane in a stable position in the grid system and as a means of centering the complete grid system in the double window pane unit. Each holding foot has a substantially flat base 30 and a substantially vertical post 31 extending from it. The holding foot also has a groove 32 extending along the center of the face of the flat base up to the post. The flat base has a width sufficient to snugly fit into the double window pane frame. The groove 32 has a width to receive a narrowed edge of the art glass pane such as found on beveled glass. The flat base width and the centered groove of the holding foot ensures that the grid system is centered in the double window pane frame. The length of the substantially flat base is not critical, though generally is about one-half inches to about one inch for manufacturing and assembly reasons. Alternatively, the vertical post can be centered in the flat base and grooves in the flat base extend from both of its sides to hold edges of two adjacent art glass panes.

Preferably, each holding foot also has a coupling means on its back side to aid in mounting the grid system in the double window pane unit. The coupling means interact with the frame of the double window pane unit to aid in the assembling and to better hold the two components together. As best seen in FIG. 3, the cones 33 protruding from the back side of the flat base 30 act as coupling means. Since the frame 13 of the double window pane unit 11 is a soft polymeric strip liner, the cones 33 become embedded in the liner sufficiently to hold them together. The interaction need only be strong enough to aid in the assembly. Once assembled, the frame of the unit provides the permanent holding force necessary. Other mechanical coupling means, such as tabs, posts, etc. can be used.

The vertical post 31 on each of the holding feet 16 fits axially into the interior channel 22 of the elongated member 15 at its terminus. It is preferably dimensioned to snugly fit into the channel to hold the holding foot steady relative to the elongated member.

The resting pads 17 are used to ensure that the art glass panes are mounted in the elongated members in a rattle free state. They are used in a highly preferred embodiment of the invention. Each pad 17 is capable of being positioned in either the first groove or the second groove at a point where it will best receive an edge of the art glass pane and, in conjunction with the holding feet, hold it in a substantially stable state. Thus, as seen in FIG. 1, the resting pads are positioned near an interior corner of the grid where two elongated members interconnect. Normally, one resting pad properly positioned for each interior edge of the art glass pane in the grid is sufficient, though a plurality of pads for one or more of the art glass pane edges can be used for added stability.

Figure 4:
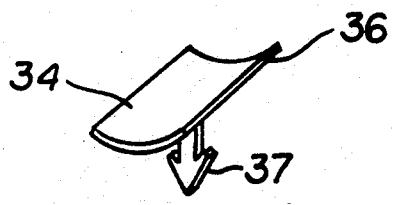
FIG. 4 is a perspective view of a first resting pad used in the grid system of the invention.
Figure 5:
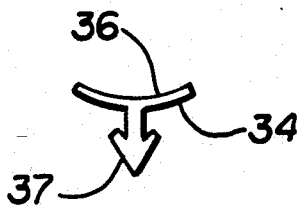
FIG. 5 is an end view of the resting pad of FIG. 4.
Figure 6:
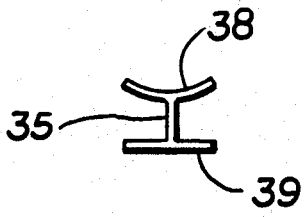
FIG. 6 is an end view of a second resting pad used in the grid system of FIG. 1.
Figure 7:
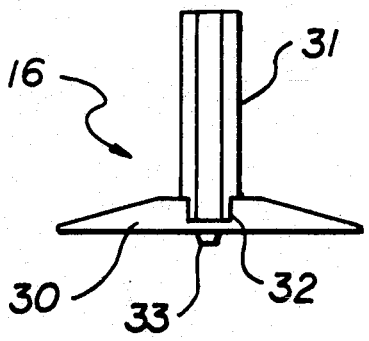
FIG. 7 is an end view of a holding foot used in the grid system of FIG. 1.

Each resting pad 17 is structured according to whether it will be used in a groove with a closed bottom or a groove with an open bottom. The resting pad 34 shown in FIGS. 4 and 5 are used in the first groove of the elongated member 15 while the resting pad 35 shown in FIG. 6 is used in the second groove of the elongated member 15. Each serves the purpose of providing a means whereby an interior corner of the grid is able to stably hold a piece of art glass.

FIGS. 4 and 5 illustrate the resting pads 34 used in the first or closed bottom groove of the elongated members 15. The resting pad 34 has a head portion 36 and a base portion 37. The head portion 36 is preferably saddle-shaped and preferably made of a flexible material. The base portion 37 is a locking tab which extends from the head portion 36. It mates with the hole 24 punched into the first groove of an elongated member prior to assembly. The holes in the first groove are normally positioned near an interior corner of the grid for optimum stability. Other holding means on the head portion of various designs and first groove modifications are possible for accomplishing the same purpose. For example, an adhesive backing on the head portion can serve as a holding means.

Each resting pad 35 to be used in a second or open bottom groove is comprised of a head portion 38 and a base portion 39. The base portion is preferably rigid or semi-rigid and the head portion is flexible. The base portion has an inverted T-shape and is dimensioned to fit into the interior channel and slide along it with the head portion extending into and dimensioned to fit in the bottom area of the second groove 21. As such, the flexible head portion of the pad provides a seat for an edge of the art glass pane and adds a measure of stability. Preferably, the head portion 38 of the pad is saddle-shaped to better receive different thicknesses of glass panes.

The grid system 10 is readily assembled and installed in the double window pane unit 11. Initially, the elongated members are cut to length. They are interconnected by matching up the notches of each of the vertical members with the notches of the horizontal members and snapping them together to form a grid. The close fit and, in the preferred embodiment, the burr-like protrusions on the guide notches give a connection strong enough for the assembly. Next, the resting pads are pushed into the holes of the first groove where needed and other resting pads slid through the interior channel and second groove to near an interior corner where needed. The individual panes of glass are positioned in their respective sections and the holding feet slid into position. Once the holding feet are positioned, the art glass panes are secured. The glass panes are also centered due to the resting pads and holding feet grooves. The whole grid system is now ready for assembly into the double window pane unit. The grid system is placed on one window pane, the frame strip added around its periphery and the second window pane added. The whole unit is finally sealed and permanently mounted in the window frame in a conventional manner.

Figure 8:
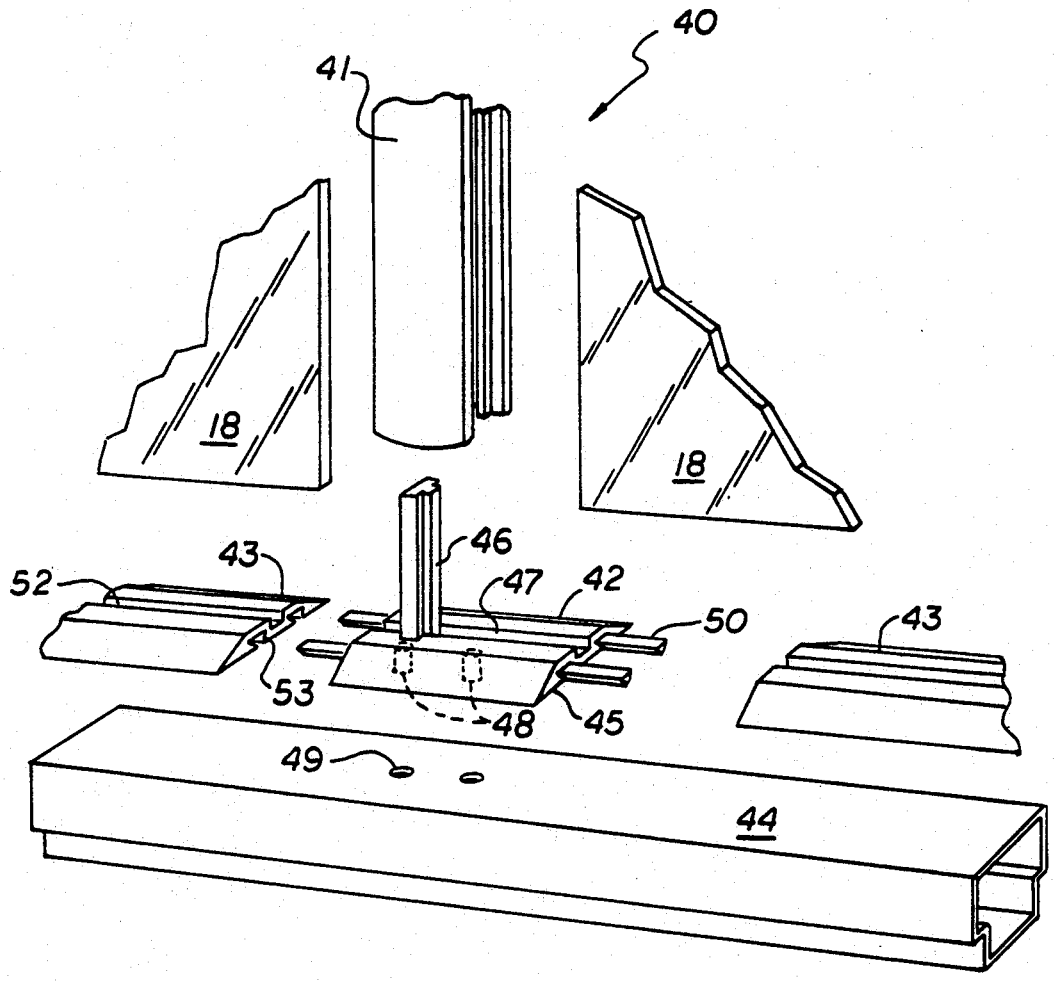
FIG. 8 is a partial exploded view in perspective of an alternative grid system of the invention.
Figure 9:
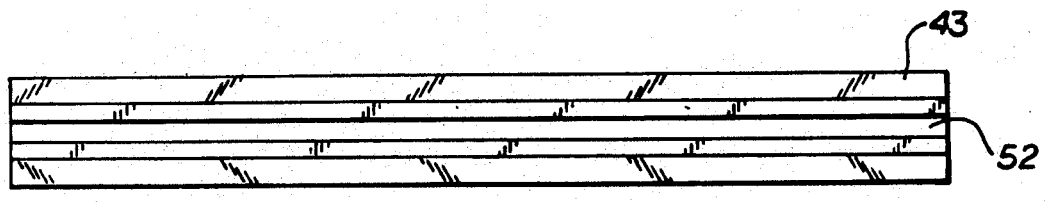
FIG. 9 is a top view of an intermediate mounting member used in the grid system of FIG. 8.

FIGS. 8 and 9 illustrate another embodiment of the grid system of the invention and another double window pane unit. This embodiment provides an especially secure means to hold art glass panes in the elongated members and for this reason is preferred. The grid system 40 as evident in FIG. 8 comprises elongated members 41, holding feet 42, and intermediate mounting members 43. Resting pads (not shown) are also optionally used in the elongated members. The elongated members 41 and resting pads are as described above with reference to FIGS. 1–6. The holding feet 42 and intermediate mounting members 43 are structured to lock together and extend the full length of one side of the grid system. The double window pane unit is similar to that described above except different frame strips are used. Thus, metal strips 44 extend around the two window panes and are connected together at their corners.

Each of the holding feet 42 has a substantially flat base 45 and a substantially vertical post 46 extending therefrom. The holding foot also has a groove 47 extending along the center of the face of the flat base up to at least one side of the post. Posts 48 extend from the back side of the flat base 45. The posts mate with holes found in the frame metal strip 44 of the alternative double window pane unit depicted in FIG. 8. The frame strips have holes 49 for receiving the posts 48 of the holding feet to aid in the assembling and to better hold the components together. A set of tabs 50 extend axially from the flat base at each end thereof. The tabs 50 are for locking into the intermediate mounting member 43 further discussed below.

The intermediate mounting member 43 is to hold an edge of the art glass and works in conjunction with the holding feet to ensure that the entire collective lengths of the individual glass panes are held. The member 43 has a substantially flat base 51 with a groove 52 running along the center of its face. The flat base also has recesses 53 in each end to receive the tabs 50 of the holding feet 42. Thus, the two recesses 53 in each end are in alignment with two tabs 49 in each holding foot 42. When assembled, the holding feet and intermediate mounting members alternate along one side of the grid system. The result is that all the individual panes of glass mounted in the system are held along their entire periphery.

While the invention has been described with particular references to the drawings, it should be understood various modifications can be made. All modifications of an obvious nature are considered within the scope of the appended claims.

I claim:

1. A grid system for securely holding a number of decorative art glass panes in a double window pane unit, said grid system comprising:

(a) a set of at least two elongated members dimensioned to interconnect with one another to form a grid and having sufficient lengths for mounting in the double window pane unit, each said elongated member having a first groove extending along one side of the member to receive an edge of each decorative art glass pane capable of being associated therewith, a second groove extending along an opposite side of the member to receive an edge of another decorative art glass pane capable of being associated therewith, and an interior channel extending along the elongated member between said first and second grooves;

(b) a set of holding feet slidably positioned in the interior channel of the elongated members, each foot having a substantially flat base which mounts in the double window pane unit, said flat base having a face with a groove extending along a center of the face to snugly hold an edge of each decorative art glass pane capable of being associated therewith and further having a post extending substantially vertically from the face of the flat base to fit into the interior channel of the elongated member to hold said foot in position; and a set of resting pads positioned in the grooves of the elongated members, each pad having a flexible head portion for receiving an edge of the decorative art glass and a holding means for retaining the resting pad in the groove of the elongated member.

2. The grid system of claim 1 wherein at least one of the resting pads is positioned in the first groove of an elongated member and at least one of the resting pads is positioned in the second groove of an elongated member.

3. The grid system of claim 2 wherein each resting pad positioned in a first groove of an elongated member has a locking tab extending from its head portion and each elongated member has a mating hole near an interior corner of the grid formed by the elongated members where the resting pad is positioned.

4. The grid system of claim 2 wherein the second groove further has a slot in a bottom wall extending its length.

5. The grid system of claim 4 wherein each resting pad positioned in the second groove of an elongated member has a base portion which has an inverted T-shape extending from the head portion and is dimensioned to fit into the interior channel of an elongated member and slide along the slot to near an interior corner of the grid formed by the elongated members.

6. The grid system of claim 1 wherein the holding feet are further characterized in having coupling means on a back side of the flat base to aid in mounting the system in the double window pane unit.

7. The grid system of claim 6 wherein the coupling means on the back side of the flat base is a set of cones extending therefrom.

8. The grid system of claim 6 wherein the coupling means on the back side of the flat base is a set of posts extending therefrom.

9. A double window pane unit comprising two window panes with a frame extending around the peripheries of the two window panes and suited for mounting in a window frame and having a grid system for holding decorative art glass panes positioned between said two window panes, said grid system having:

(a) a set of at least two elongated members dimensioned to interconnect with one another to form a grid and having sufficient lengths for mounting within the confines of the window panes, each said elongated member having a first groove extending along one side of the member to receive an edge of each decorative art glass pane capable of being associated therewith, a second groove extending along an opposite side of the member to receive an edge of another decorative art glass pane capable of being associated therewith and an interior channel extending along the elongated member between said first groove and said second groove; and (b) a set of holding feet slidably positioned in the interior channel of the elongated members, each foot having a substantially flat base which mounts in the double window pane unit, said flat base having a face with a groove to snugly hold an edge of each decorative art glass pane capable of being associated therewith and a post extending substantially vertically from the face of the flat base to fit into the interior channel of the elongated member to hold said flat base in position.

10. The double window pane unit of claim 9 wherein the frame is a soft vinyl strip liner.

11. The double window pane unit of claim 9 wherein the frame is a metal strip.

12. The double window pane unit of claim 9 further comprising a set of resting pads positioned in the grooves of the elongated members, each pad having a flexible head portion for receiving an edge of the decorative art glass.

13. The double window pane unit of claim 12 wherein at least one of the resting pads is positioned in the first groove of an elongated member and at least one of the resting pads is positioned in the second groove of an elongated member.

14. The double window pane unit of claim 13 wherein each resting pad positioned in the first groove of an elongated member has a locking tab extending from its head portion and each elongated member has a mating hole near an interior corner of the grid formed by the elongated members where the resting pad is positioned.

15. The double window pane unit of claim 13 wherein the second groove of each elongated member has a slot extending its length and each resting pad positioned in the second groove of an elongated member has a base portion which has an inverted T-shape extending from the head portion and is dimensioned to fit into the interior channel of the elongated member and slide along the slot to near an interior corner of the grid formed by the elongated members.

16. The double window pane unit of claim 9 wherein each holding foot of the grid system is further characterized in having coupling means on a back side of the flat base of the holding foot to aid in mounting the system in the double window pane unit.

17. The double window pane unit of claim 16 wherein the coupling means on the back side of the flat base of each holding foot is a set of cones extending therefrom and the frame of the double window pane unit is a soft polymeric strip liner.

18. The double window pane unit of claim 16 wherein the coupling means on the back side of the flat base of each holding foot is a set of posts extending therefrom and the frame of the double window pane unit is a metal strip with mating holes for the posts.

19. A grid system for securely holding a number of decorative art glass panes in a double window pane unit, said grid system comprising:

(a) a set of at least two elongated members dimensioned to interconnect with one another to form a grid and having sufficient lengths for mounting in the double window pane unit, each said elongated member having a first groove extending along one side of the member to receive an edge of each decorative art glass pane capable of being associated therewith, a second groove extending along an opposite side of the member to receive an edge of another decorative art glass pane capable of being associated therewith and an interior channel extending along the elongated member between said first and second grooves;

(b) a set of holding feet slidably positioned in the interior channel of the elongated members, each foot having a substantially flat base which mounts in the double window pane unit, said flat base having a face with a groove to snugly hold an edge of each decorative art glass pane capable of being associated therewith and a post extending substantially vertically from the face of the flat base to fit into the interior channel of the elongated member to hold said foot in position; and (c) a set of resting pads positioned in the grooves of the elongated members, each pad having a flexible head portion for receiving an edge of the decorative art glass and a holding means for retaining the resting pad in the groove of the elongated member.

* * * * *